US006015331A

United States Patent [19]

Ioakim

[11] Patent Number: 6,015,331

[45] Date of Patent: Jan. 18, 2000

[54] NIGHTTIME NURSING TUBE BRA

[76] Inventor: Debbie M. Ioakim, 6282 Pine Terrace Cir., Milton, Fla. 32570

[21] Appl. No.: 09/067,984

[22] Filed: Apr. 29, 1998

[51] Int. Cl.[7] ..... A41C 3/00

[52] U.S. Cl. ..... 450/37; 450/58

[58] Field of Search ..... 2/104–106, 113–115, 2/267–268, 73, 67; 450/30–32, 36, 37, 53–57, 58; 602/19, 20

[56] References Cited

U.S. PATENT DOCUMENTS

| | | | |
|---|---|---|---|
| 1,984,253 | 12/1934 | Cox . | |
| 2,458,696 | 1/1949 | Elias . | |
| 4,100,621 | 7/1978 | Ettipio | 2/114 |
| 4,390,024 | 6/1983 | Williams | 128/460 |
| 4,640,287 | 2/1987 | Anderson et al. | 128/460 |
| 4,911,677 | 3/1990 | White | 450/36 |
| 5,094,647 | 3/1992 | Courtney | 450/36 |
| 5,182,813 | 2/1993 | Booze | 2/104 |

*Primary Examiner*—Gloria M. Hale
*Attorney, Agent, or Firm*—Joseph N. Breaux

[57] ABSTRACT

A nighttime nursing tube bra comprising a front central portion having a first constant width and first and second side portions coupled to the left and right of the front central portion. The top and bottom portions of the front central portion and the first and second side portions have coupled therealong elastomeric band members which resiliently collapse around the wearer's body immediately above and below the breasts of the wearer. The free ends of first and second side portions, preferably, are securable via VELCRO® to form an tube bra around the chest of a nursing mother. The front central portion includes first and second releasable panels which permits easy access to the wearer's breast. In the preferred embodiment, the tube bra is made of a absorbent material such as terry cloth.

1 Claim, 2 Drawing Sheets

NIGHTTIME NURSING TUBE BRA

TECHNICAL FIELD

The present invention relates to nursing brassieres and, more particularly, to a nighttime nursing tube bra having a tubular bra member having a forward central portion including a first elastomeric band along a top edge, a second elastomeric band along a bottom edge and a first number of spaced hook and pile fastener sections spaced along a perimeter of an interior surface thereof; and a liner member sized and shaped to conform to the forward central portion, the liner member being constructed from an absorbent, launderable fabric, such as terry cloth, and including a second number of hook and pile faster sections spaced about the liner member perimeter thereof, the first and second numbers of hook and pile fastener sections being securable together to attach the liner member to the interior surface of the forward central portion.

BACKGROUND OF THE INVENTION

After having a baby, a mother oftentimes breast feeds the newborn baby. Therefore, several brassieres have been designed to provide access to the breast without the need to take off the brassiere. As is known, the mother's breast size after the baby is born is significantly larger than her normal breast size. Therefore, while sleeping, some mothers wear brassieres to sleep to support the weight of their breasts. Additionally, at night since the breast are filled with the mother's milk, the breasts leak with the mother's milk which soils the bed linens.

The existing nursing bras have straps which support the bra around the shoulders of the mother which is uncomfortable while sleeping. Moreover, if the mother needs to breast feed the baby in the middle of the night, some of the nursing bras utilize snaps and hooks which are cumbersome to operate when the mother is, if you will, half asleep.

Several examples of patented nursing bras or garments are described below.

U.S. Pat. No. 5,182,813, to Booze, entitled "NURSING GARMENT" discloses a garment in the form of a hospital gown for mothers who may need to nurse their baby. The garment is made of flexible material, has a vertical inwardly facing pleat centered on and along the upper front in the vicinity of the breasts of the wearer. The pleat includes an interior fold line which incorporates an opening therealong to provide access to the breasts of the wearer.

U.S. Pat. No. 5,094,647, to Courtney, entitled "NURSING GARMENT" discloses a nursing bra which includes at least one cup which fits over a breast of the user. The cup includes a flap for selectively concealing or exposing the breast. A focus pattern is provided on the cup located so that it can be viewed by the infant during nursing. The bra shown has straps.

U.S. Pat. No. 4,911,677, to White, entitled "NURSING BRA" discloses a nursing brassiere having a frontal section comprised of partially overlapping frontal portions each adapted to cover one side of a wearer's chest area. The frontal portions are connected to a lower band that fits around the wearer and has inner and outer overlapping members. The bra shown has straps.

U.S. Pat. No. 4,640,287, to Anderson et al., entitled "RELEASABLE FASTENING MEANS AND METHOD FOR CLOTHING ITEMS, PARTICULARLY CAPS, BRASSIERES, AND NURSING BRASSIERES" discloses the use of VELCRO® can be used as a fastening means for various clothing items. The bra shown has straps.

U.S. Pat. No. 4,390,024, to Williams, entitled "MATERNITY BRASSIERE" discloses a bra with straps and includes detachable inner cup sections which overlay the inner portions of wide stretchable bands.

While each of the above brassieres function as desired, none of them disclose a nighttime nursing tube bra that can be easily pulled down to expose one or more breasts and that includes a detachable, launderable liner member.

As will be seen more fully below, the present invention is substantially different in structure, methodology and approach from that of the prior nursing brassieres or garments.

SUMMARY OF THE INVENTION

In view of the above, an object of the present invention is to provide a nighttime nursing tube bra which does not necessarily firmly or bindingly support the wearer's breast close to the body when worn as conventional support nursing bras would.

It is a still further object of the present invention to provide a nighttime nursing tube bra which is devoid of shoulder straps.

It is a still further object to provide a nighttime nursing tube bra that does not have discrete cup portions for the placement of the wearer's breasts, as do conventional nursing bras.

It is a still further object of the present invention to provide a nighttime nursing tube bra which eliminates the need to operate buckles, snaps and/or hooks before a child can be nursed.

It is a still further object of the present invention to provide a nighttime nursing tube bra having a tubular bra member having a forward central portion including a first elastomeric band along a top edge, a second elastomeric band along a bottom edge and a first number of spaced hook and pile fastener sections spaced along a perimeter of an interior surface thereof; and a liner member sized and shaped to conform to the forward central portion, the liner member being constructed from an absorbent, launderable fabric, such as terry cloth, and including a second number of hook and pile faster sections spaced about the liner member perimeter thereof, the first and second numbers of hook and pile fastener sections being securable together to attach the liner member to the interior surface of the forward central portion.

It is a still further object of the invention to provide a nighttime nursing tube bra that accomplishes one or more of the above objects in combination.

Accordingly, a nighttime nursing tube bra is provided. The nighttime nursing tube bra includes a tubular bra member having a forward central portion including a first elastomeric band along a top edge, a second elastomeric band along a bottom edge and a first number of spaced hook and pile fastener sections spaced along a perimeter of an interior surface thereof; and a liner member sized and shaped to conform to the forward central portion, the liner member being constructed from an absorbent, launderable fabric, such as terry cloth, and including a second number of hook and pile faster sections spaced about the liner member perimeter thereof, the first and second numbers of hook and pile fastener sections being securable together to attach the liner member to the interior surface of the forward central portion.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
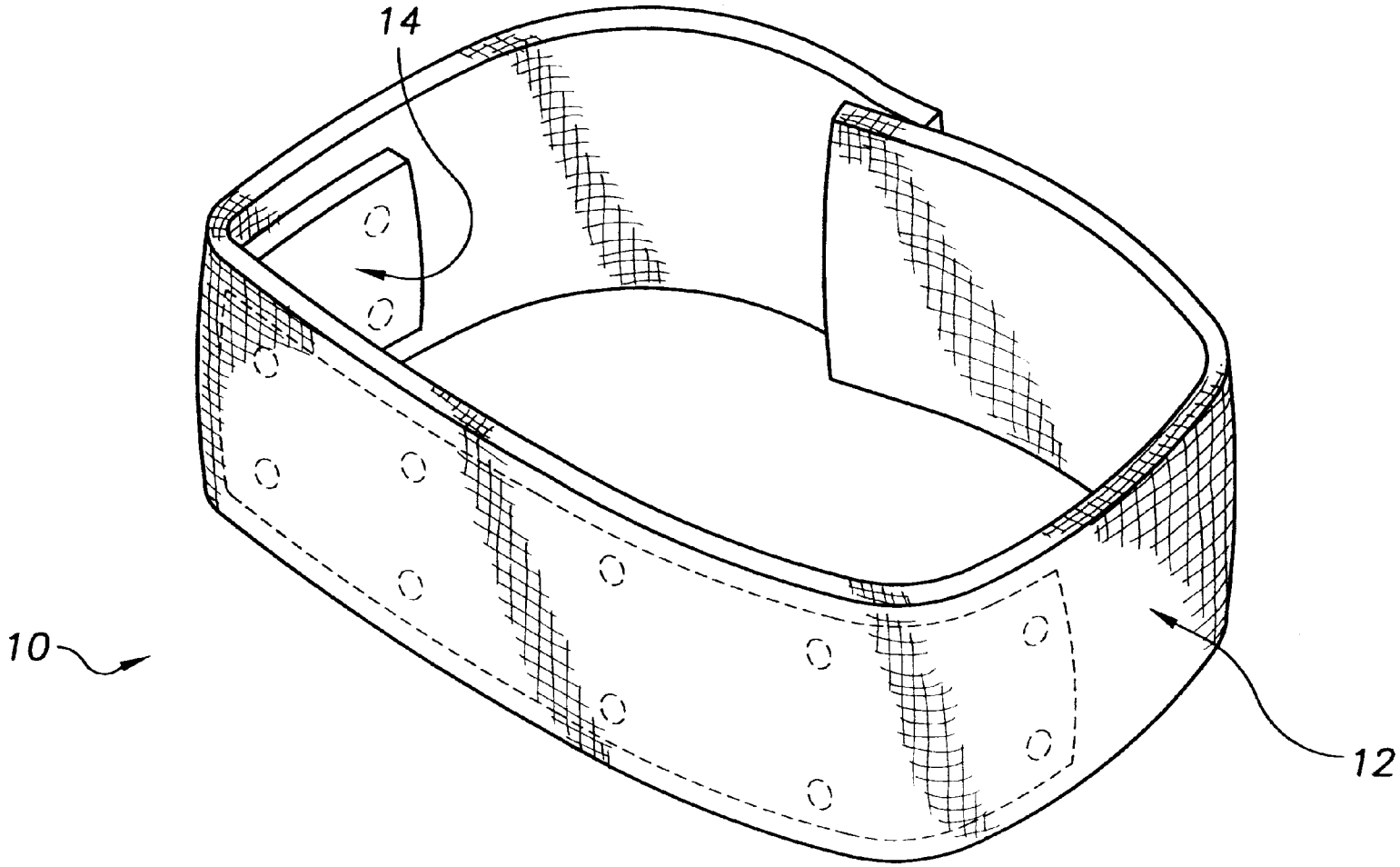
FIG. 1 is a perspective view of an exemplary embodiment of the nighttime nursing tube bra of the present invention showing the tubular bra member and the liner member secured together.
Figure 2:
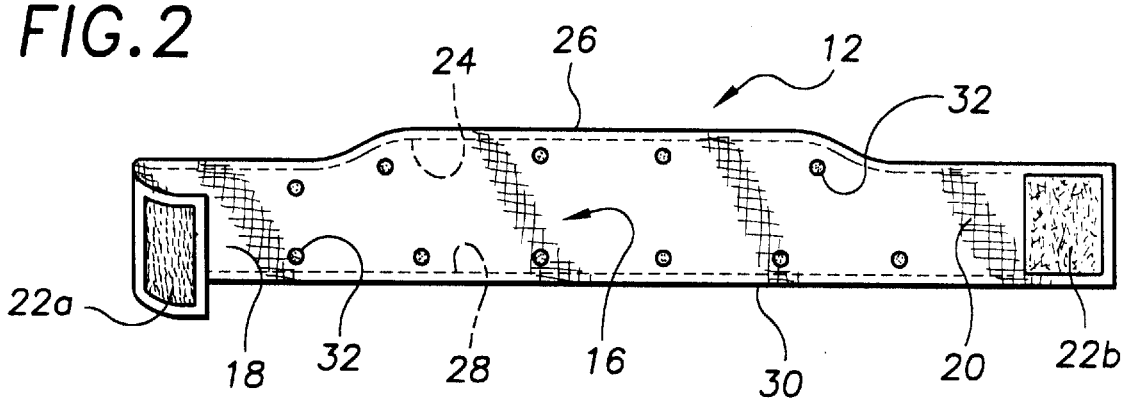
FIG. 2 is a plan view of the interior facing surface of the exemplary tubular bra member of FIG. 1 in isolation showing the forward central portion defined between two end sections each terminating in a hook and pile tube fastener section; the first elastomeric band along and past a top edge of the central portion; the second elastomeric band along and past a bottom edge of the central portion; and the first number of spaced hook and pile fastener sections spaced along the perimeter of and an interior surface of the forward central portion.

FIG. 1 shows an exemplary embodiment of the nighttime nursing tube bra of the present invention, generally designated by the numeral 10. Nighttime nursing tube bra 10 includes a tubular bra member, generally designated 12 and a liner member, generally designated 14, that are securable together. With reference now to FIG. 2, tubular bra member 12 is constructed from a woven fabric material and includes a forward central portion, generally designated 16 defined between a left end section 18 and a right end section 20. Left end section 18 and right end section 20 each terminate in a hook and pile tube fastener section 22*a*, 22*b* that are securable to each other so as to form tubular bra member 12 into a closed tube shape. A first elastomeric band 24 is secured along and past a top edge 26 of central portion 16. A second elastomeric band 28 is secured along and past a bottom edge 30 of central portion 16. A first number of spaced hook and pile fastener sections 32 are spaced along the perimeter of and to an interior surface of forward central portion 16. In use, the top edge 26 of central portion 16 is pulled out and down below the breast or breasts to expose the breast or breasts for nursing. When nursing is finished, top edge 26 of central portion 16 is pulled out and up and over the breast or breasts to cover the previously exposed breast or breasts.

Figure 3:
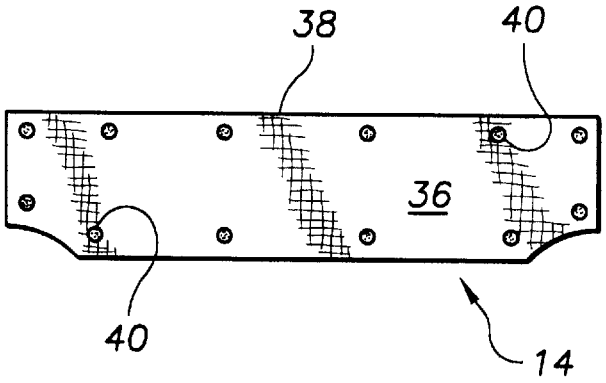
FIG. 3 first plan view of the bra member facing surface of the exemplary liner member of FIG. 1 in isolation showing the liner member perimeter edge and the second number of hook and pile faster sections spaced about the liner member perimeter.
Figure 4:
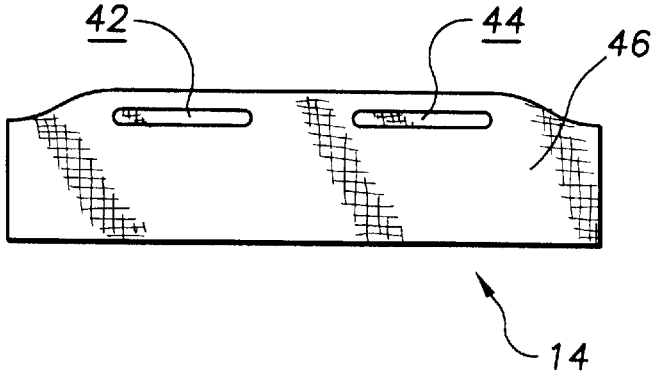
FIG. 4 second plan view of the user facing surface of the exemplary liner member of FIG. 1 in isolation showing the left and right absorbent pad receiving pocket openings for receiving optional absorbent material if desired by the user.

With reference now to FIG. 3, liner member 14 is constructed of absorbent terry cloth fabric and has a bra member facing surface 36 defined by a liner member perimeter edge 38 and to which a second number of hook and pile faster sections 40 are secured. Second number of hook and pile fastener sections 40 are spaced about liner member perimeter edge 38 such that they correspond to the placement of first number of spaced hook and pile fastener sections 32 (FIG. 2) when bra member facing surface 36 is in facewise registration with forward central portion 16. With reference to FIG. 4, in this embodiment, liner member 14 is provided with left and right absorbent pad receiving pocket openings 42,44 into the user contact surface 46 for receiving additional optional absorbent material pads if desired by the user.

It can be seen from the foregoing description that a nighttime nursing tube bra has been provided that does not bindingly support the wearer's breast close to the body when worn as conventional support nursing bras would; that is devoid of shoulder straps; that does not have discrete cup portions for the placement of the wearer's breasts, as do conventional nursing bras; that does not require operation of buckles, snaps and hooks to allow nursing; and that has a forward central portion including a first elastomeric band along a top edge, a second elastomeric band along a bottom edge and a first number of spaced hook and pile fastener sections spaced along a perimeter of an interior surface thereof; and a liner member sized and shaped to conform to the forward central portion, the liner member being constructed from an absorbent, launderable fabric, such as terry cloth, and including a second number of hook and pile faster sections spaced about the liner member perimeter thereof, the first and second numbers of hook and pile fastener sections being securable together to attach the liner member to the interior surface of the forward central portion.

It is noted that the embodiment of the nighttime nursing tube bra described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A nighttime nursing tube bra securable about breasts of a wearer comprising:

a tubular bra member having a forward central portion including a first elastomeric band along a top edge, a second elastomeric band along a bottom edge and a first number of spaced hook and pile fastener sections spaced along a perimeter of an interior surface thereof; and a liner member sized and shaped to conform to said forward central portion, said liner member being constructed from an absorbent, launderable fabric, and including a second number of hook and pile faster sections spaced about said liner member perimeter thereof, said first and second numbers of hook and pile fastener sections being securable together to attach said liner member to said interior surface of said forward central portion.

* * * * *